US007824738B2

(12) United States Patent
Smith et al.

(10) Patent No.: US 7,824,738 B2
(45) Date of Patent: Nov. 2, 2010

(54) COATINGS FOR TURBINE BLADES

(75) Inventors: John Smith, Hatfield (GB); Sharad Chandra, Oberhausen (DE)

(73) Assignees: Diffusion Alloys Limited, Hatfield, Herts (GB); Man Turbo AG, Oberhausen (DE)

( * ) Notice: Subject to any disclaimer, the term of this patent is extended or adjusted under 35 U.S.C. 154(b) by 705 days.

(21) Appl. No.: 11/587,857

(22) PCT Filed: Feb. 4, 2005

(86) PCT No.: PCT/GB2005/000374

§ 371 (c)(1),
(2), (4) Date: Apr. 13, 2007

(87) PCT Pub. No.: WO2005/106064

PCT Pub. Date: Nov. 10, 2005

(65) Prior Publication Data

US 2008/0057189 A1 Mar. 6, 2008

(30) Foreign Application Priority Data

Apr. 28, 2004 (GB) ..... 0409486.8

(51) Int. Cl.
*B05D 3/00* (2006.01)

(52) U.S. Cl. ..... 427/383.1; 427/237; 427/239

(58) Field of Classification Search ..... 427/383.1, 427/237, 239, 255

See application file for complete search history.

(56) References Cited

U.S. PATENT DOCUMENTS 3,257,230 A 6/1966 Wachtell et al.
3,716,398 A 2/1973 Stueber et al.
3,762,884 A 10/1973 Grisaffe et al.
4,096,296 A * 6/1978 Galmiche et al. ..... 427/247
4,208,453 A 6/1980 Baldi
4,332,843 A 6/1982 Ahuja
4,347,267 A 8/1982 Baldi
4,528,215 A * 7/1985 Baldi et al. ..... 427/252
4,615,920 A 10/1986 Baldi
4,617,202 A 10/1986 Baldi
5,824,366 A 10/1998 Bose et al.

(Continued)

FOREIGN PATENT DOCUMENTS

EP 0 696 649 A1 2/1996

(Continued)

*Primary Examiner*—Lan Vinh
*Assistant Examiner*—Maki A Angadi
(74) *Attorney, Agent, or Firm*—McDermott Will & Emery LLP

(57) ABSTRACT

This invention relates to the simultaneous treatment of the internal and external surfaces of turbine blades or vanes. In particular it provides a process for coating an external and an internal surface of a turbine blade or vane with aluminium and chromium, respectively, at substantially the same time. The process comprises the following steps (i) and (ii) in either order: (i) applying to the external surface an aluminising compound comprising aluminium, a moderator, an energiser and a diluent; and (ii) applying to the internal surface a chromising compound comprising chromium, an energiser and a diluent. These steps are followed by (iii) heating the turbine blade or vane to form an aluminium layer on the external surface and a chromium layer on the internal surface. The invention also provides a suitable aluminising compound and a chromising compound per se.

7 Claims, 1 Drawing Sheet

U.S. PATENT DOCUMENTS

| | | | | |
|---|---|---|---|---|
| 6,180,170 | B1 | 1/2001 | Grossman et al. | |
| 6,217,668 | B1 * | 4/2001 | Czech et al. | 134/3 |

FOREIGN PATENT DOCUMENTS

| | | | |
|---|---|---|---|
| EP | 1 001 046 | A1 | 5/2000 |
| GB | 828700 | | 2/1960 |
| GB | 950572 | | 2/1964 |
| GB | 1 436 834 | | 5/1976 |
| JP | 53-018437 | | 2/1978 |
| JP | 05-156423 | | 6/1993 |
| JP | 2000-144372 | | 5/2000 |
| JP | 2001-068151 | | 3/2001 |
| JP | 2002-266064 | | 9/2002 |

* cited by examiner

COATINGS FOR TURBINE BLADES

RELATED APPLICATIONS

This application is the U.S. National Phase under 35 U.S.C. §371 of International Application No. PCT/GB2005/000374, filed on Feb. 4, 2005, which in turn claims the benefit of British Application No. 0409486.8, filed on Apr. 28, 2004, the disclosures of which Applications are incorporated by reference herein.

BACKGROUND OF THE INVENTION

1. Field of the Invention

This invention relates to coatings for turbine blades and particularly to the simultaneous treatment of the internal and external surfaces of turbine blades.

2. Background Art

Today the modern industrial gas turbine operates under conditions that are very aggressive for the nickel and cobalt alloys that are typically used in an engine's hot section. Therefore these alloys are attacked rapidly by the atmosphere in this region of the turbine causing them to degrade and necessitate their premature replacement. The metals that are added to nickel or cobalt alloys to improve the alloys' resistance to corrosive and oxidative environments cannot be added in sufficient concentrations without having a detrimental effect on the alloys' mechanical properties. It is for this reason that protective coatings have been developed thus producing the properties that are required at the surface of the component without having a detrimental effect on the mechanical properties of the base material.

Nowadays the surface engineering solutions used on industrial gas turbines are very diverse and several coating systems may be utilised on an individual turbine blade.

The chemically aggressive environment within land-based power generation gas turbines may lead to corrosion involving alkali and transition metal sulphates at temperatures from 600 to 800° C. (Type II corrosion), corrosion involving molten sulphates from 750 to 950° C. (Type I corrosion), and gaseous oxidation at higher temperatures. Protection of the base material under such conditions is difficult and requires the use of corrosion resistant coatings. Separate coating compositions need to be used for the differing corrosion environments, typically a chromia former (e.g. a chromide diffusion coating) to protect against Type II attack and an alumina former (e.g. an aluminide diffusion coating) for Type I and high temperature attack.

It is standard in the art to employ aluminide coatings to protect turbine blades from high-temperature oxidation and corrosion. It is also currently accepted that enrichment of the surface layer with aluminium provides satisfactory protection against Type I sulphidation. This is the result of the formation of an alumina scale that provides an effective barrier to the penetration of corrosive elements, such as sulphur and oxygen. Chromium cannot be used at the elevated temperatures that are experienced when Type I sulphidation is seen since the oxide scale formed by chromium has a significant vapour pressure at these temperatures. This means that the scale effectively evaporates from the surface and the protection is lost. This is the typical situation observed on the external surface of a gas turbine blade.

At elevated temperatures the turbine blades must be cooled. Cooling may be achieved by forcing compressed air, which may contain sulphur besides oxygen, through cooling channels in the turbine blade. Accordingly, the temperatures experienced on the metal surfaces in this internal region are lower than the temperatures experienced on the external surfaces. Aluminium scales do not form readily at these temperatures where Type II sulphidation occurs and hence aluminium does not provide effective protection against this type of attack. However, chromium oxide scales form readily at this temperature and are also physically stable and hence do provide effective protection against this type of attack.

Therefore the preferred coating system on a turbine blades where Type II sulphidation occurs on the internal surfaces and Type I sulphidation occurs on the external surfaces is aluminium coatings on the external surface and chromium coatings on the internal surfaces.

As well as the turbine blades, the vanes are also made from similar materials to the blades and may also have cooling channels. They are, therefore, subject to similar attacks as the blades.

It is common in the industry that chemical vapour deposition (also termed "diffusion coatings") is used to apply these protective coatings to industrial gas turbines. In general these coatings are formed when the surface that requires protection is brought into contact with an atmosphere that is rich in the metal to be deposited on the surface. The metal species is usually in the form of a volatile halide. This deposition occurs generally at elevated temperatures (i.e. in excess of 800° C.) and in the presence of a reducing atmosphere, such as hydrogen.

Diffusion coatings of chromium and aluminium are applied in two separate coating runs. However there are several disadvantages to this approach as a viable industrial process. For example, two consecutive processes increases the cost for protecting the turbine blade, it adds significantly to the time that it takes to carry out the process, and the second process to be carried out affects the results of the first coating process.

BRIEF SUMMARY OF THE INVENTION

Accordingly, the present invention provides a process for coating an external and an internal surface of a turbine blade or vane with aluminium and chromium, respectively, at substantially the same time comprising the following steps (i) and (ii) in either order: (i) applying to the external surface an aluminising compound comprising aluminium, a moderator, an energiser and a diluent; (ii) applying to the internal surface a chromising compound comprising chromium, an energiser and a diluent; followed by: (iii) heating the turbine blade or vane to form an aluminium layer on the external surface and a chromium layer on the internal surface.

There is a distinct commercial and technical advantage in applying the chromium and aluminium protective coatings at the same time.

BRIEF DESCRIPTION OF THE DRAWINGS

The present invention will now be described with reference to the accompanying drawing, in which the FIGURE shows a schematic representation of a turbine blade with internal cooling channels suitable for use with the process of the present invention.

With reference to the FIGURE, area A (external surfaces) is to be coated with an aluminium diffusion coating and area B (internal surfaces) is to be coated with chromium diffusion coating. The applicant has found that by modifying both the aluminising compound and chromising compound both coatings may be applied substantially simultaneously.

DETAILED DESCRIPTION OF THE INVENTION

Figure 1:
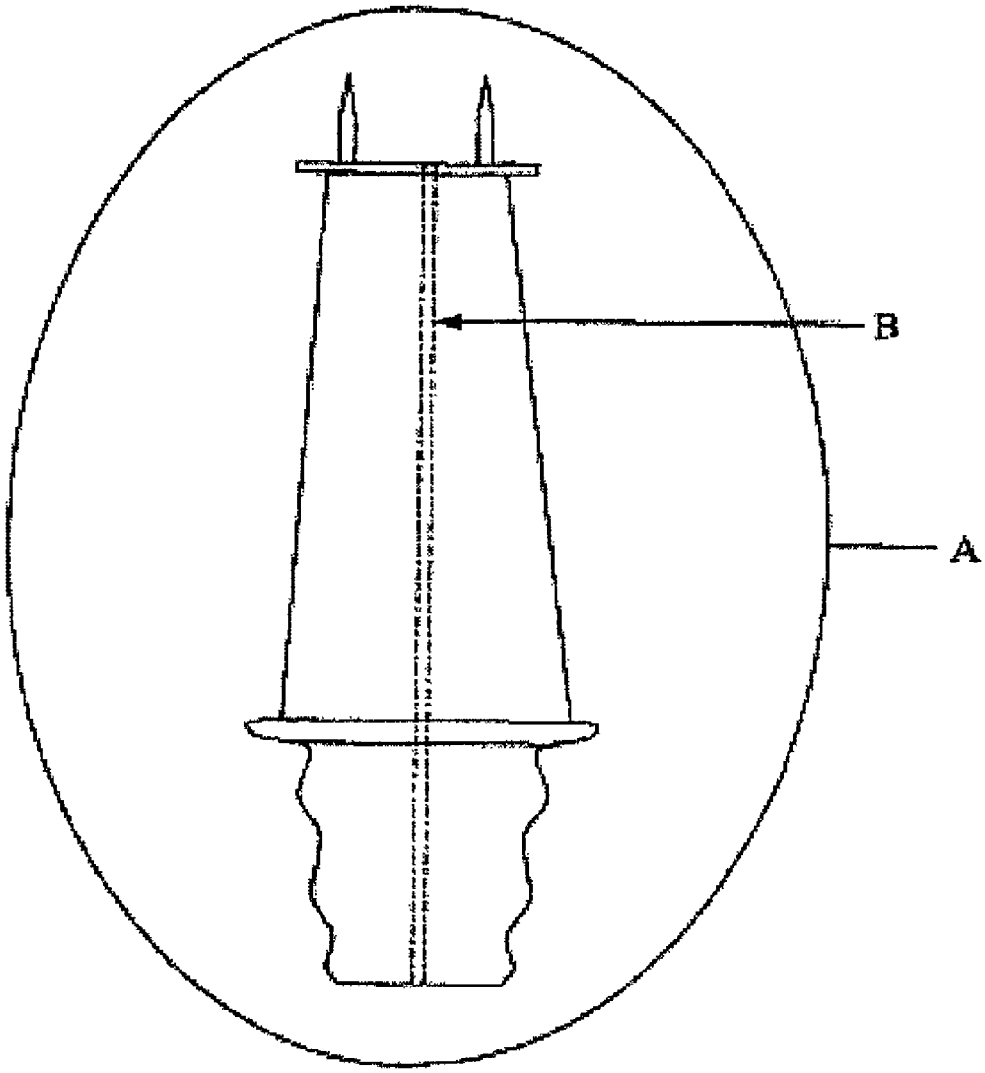

The external aluminium diffusion coating is applied by immersing the complete blade or vane in an aluminising compound (or "pack"). The aluminising compound comprises aluminium metal powder, a moderator, a ceramic diluent and an energiser.

For aluminisation, an aluminium halide is generated in situ. Accordingly, the aluminising compound contains aluminium in an amount to produce sufficient aluminium halide to coat the external surface of the blade or vane. The aluminium content is preferably 3-20 wt % based on the total weight of the aluminising compound.

A moderator, usually a metal powder such as chromium, nickel or iron, is required to absorb the aluminium halide vapour produced in situ to provide a reduced vapour pressure of aluminium halide vapour at the surface of the blade or vane which encourages diffusion into the surface alloy rather than deposition of a layer of aluminium on the surface of the alloy. The amount of moderator must be sufficient to provide diffusion rather than deposition. However, since diffusion is temperature controlled, as the temperature increases, diffusion is favoured and hence less moderator is required. In addition, the aluminising compound of the present invention employs a greater than usual content of moderator so that aluminising may take place under the same conditions as chromising. Preferably the moderator is present at 10-50 wt %, based on the total weight of the aluminising pack. The ratio of aluminium to moderator is typically 1:2 to 1:5, preferably 1:2.5 to 1:3.5, more preferably 1:2.5.

The energizer used for the aluminising process generally contains a halide element such as bromide, chloride or fluoride. The preferred halides are alkali metals, e.g. sodium, and ammonium, ammonium chloride being particularly preferred. The energiser is generally present at 0.1-2 wt %, preferably 0.5 wt %, based on the total weight of the aluminising pack.

The aluminising compound is present in a sufficient amount to generate a sufficiently thick coating of aluminium. A sufficiently thick coating is typically 60 to 100 μm. The aluminium concentration at the surface blade or vane is generally 25 to 45 wt %, the remainder being the base alloy.

Such an aluminising compound is not known in the art and hence the present invention also provides an aluminising compound comprising 3-20 wt % aluminium, 10-50 wt % moderator, 0.1-2 wt % energiser and at least 20 wt % diluent, wherein the weight ratio of aluminium to moderator is from 1:2 to 1:5.

The external surface of the turbine blade or vane may be pre-treated, e.g. sprayed with an additional coating, before aluminisation if required.

The internal surface is chromised at substantially the same time as the external surface by also charging the internal cooling channels with a chromising compound. By substantially the same time, it is meant that the aluminising compound and the chromising compound are both initially applied to the turbine blade or vane and then both coatings are then formed during the subsequent diffusion heat treatment.

The chromising compound comprises chromium metal powder, a ceramic diluent and an energiser.

For chromisation, a chromium halide is also generated in situ. Accordingly, the chromising compound contains chromium in an amount to produce sufficient chromium halide to coat the internal surface of the blade or vane, i.e. the cooling holes. The chromium content is preferably 15-65 wt % based on the total weight of the chromising compound.

The energizer used for the chromising process generally contains a halide element such as iodide, bromide, chloride or fluoride. The preferred halides are alkali metals, e.g. sodium, and ammonium, ammonium chloride being particularly preferred. The energiser is generally present at 0.1-5 wt %, preferably 1 wt %, based on the total weight of the chromising compound.

The diluent is generally a refractory oxide powder that makes up the balance of the ingredients in the chromising compound. The diluent is preferably $Al_2O_3$ (alumina), $TiO_2$ (titania), MgO or $Cr_2O_3$. The most preferred refractory diluent is calcined alumina. The diluent content must be sufficient to keep the chromising pack free flowing which is typically at least 20 wt %, preferably at least 25 wt %, based on the total weight of the chromising pack.

The particles of the chromising compound must have a sufficiently small particle size to allow a sufficient amount of the chromising compound to access the internal surfaces, i.e. to get into the cooling holes, and therein to generate a sufficiently thick coating of chromium. A sufficiently thick coating is typically 10 to 60, preferably 10 to 50, most preferably 10 to 20 μm. The chromium concentration at the surface of the cooling hole is generally 30 to 60 wt %, the remainder being the base alloy. The particle size of the chromising compound is preferably 200 μm mesh size or less, preferably 100 μM mesh size or less, most preferably 75 μm mesh size or less. Any minimum value (excluding zero) may be used although as the particle size gets lower the pack becomes more expensive and the benefits of the reduced particle size decreases.

Such a chromising compound is not known in the art and hence the present invention also provides a chromising compound comprising 15-65 wt % chromium, 0.1-5 wt % energiser and at least 20 wt % diluent, wherein the particle size of the chromising compound is such that the chromising compound is capable of passing through a 200 μm mesh or less.

During the substantially simultaneous aluminising and chromising processes the aluminising and chromising compounds should be protected from attack by atmospheric oxygen. Protection may involve an inert atmosphere, which may be produced by ammonium salts present in the compounds which decompose at elevated temperatures to liberate hydrogen. Alternatively, or in addition, protection may be provided by a reducing atmosphere, such as hydrogen or a hydrogen-containing gas mixture, e.g. 5% hydrogen in argon.

The retort containing the various coating compounds and the turbine blade or vane is placed in a furnace that is provided with an inert or reducing atmosphere, typically 5% hydrogen in argon or pure hydrogen. The turbine blade or vane in the furnace is then heated to a temperature from 850 to 1150° C., preferably 900 to 1100° C., more preferably 1000 to 1050° C., for 1 to 24 hours, preferably 2 to 10 hours, under the above protective atmosphere. After this treatment cycle the component is allowed to cool to ambient temperature under the protective atmosphere. The blade or vane is then removed from the aluminising compound and gentle tapping or vibration removes the chromising compound. After the removal of the excess coating compounds from the surface of the blade it is desirable to heat treat the blade so that the required mechanical properties can be achieved in the base material.

Example

The cooling holes of a turbine blade are charged with a chromising compound containing 30 wt % chromium metal powder, 69 wt % calcined alumina and 1 wt % ammonium chloride. The blade is then immersed in an aluminising compound containing 18 wt % aluminium metal powder, 45 wt % chromium metal powder and 0.5 wt % ammonium chloride, the balance being calcined alumina. The retort containing the various coating compounds and the turbine blade is placed in a furnace under a reducing atmosphere of 5% hydrogen in argon. The turbine blade in the furnace is then heated at a temperature of 1040° C. for 6 hours under the above protective atmosphere. After this treatment cycle the turbine blade is allowed to cool to ambient temperature under the protective atmosphere. The blade is then removed from the aluminising compound and the chromising compound removed by gentle tapping. After the removal of the excess coating compounds from the surface of the blade, the blade is heat treated so that the required mechanical properties can be achieved in the base material.

The resulting blade has its internal surfaces coated with chromium to a sufficient thickness to resist type II corrosion and its external surfaces coated with aluminium to a sufficient thickness to resist type I corrosion.

The invention claimed is:

1. A process for coating an external and an internal surface of a turbine blade or vane with aluminium and chromium, respectively, at substantially the same time comprising the following steps (i) and (ii) in either order:

(i) applying to the external surface an aluminising compound comprising aluminium, a moderator, an energiser and a diluent by immersing the blade or vane in the aluminising compound, where the aluminising compound comprises 3-20 wt % aluminium, 10-50 wt % moderator, 0.1-2 wt % energiser and at least 20 wt % diluent, and the weight ratio of aluminium to moderator is from 1:2 to 1:5;

(ii) applying to the internal surface a chromising compound comprising chromium, an energiser and a diluent, wherein the chromising compound comprises 15-65 wt % chromium, 0.1-5 wt % energizer and at least 20 wt % diluent, and the weight ratio of aluminium to moderator is from 1:2 to 1:5; followed by:

(iii) heating the turbine blade or vane to form an aluminium layer on the external surface and a chromium layer on the internal surface.

2. A process as claimed in claim 1, wherein the particles of the chromising compound have a sufficiently small particle size to allow a sufficient amount of the chromising compound to access the internal surface.

3. A process as claimed in claim 2, wherein the particle size of the chromising compound is such that the chromising compound is capable of passing through a 200 μm mesh or less.

4. A process as claimed in any preceding claim, wherein the heating is carried out at 850 to 1150° C.

5. A process as claimed in any of claims 1, 2 or 3, wherein the heating is carried out for 1 to 24 hours.

6. A process as claimed in any of claims 1, 2 or 3, wherein the external surface of the turbine blade or vane is pre-treated with an additional coating.

7. A process as claimed in claim 6, wherein the additional coating is applied by spraying.

* * * * *